US005327634A

United States Patent [19]

Gagneux

[11] Patent Number: 5,327,634

[45] Date of Patent: Jul. 12, 1994

[54] PROCESS FOR IMPROVING ELASTICITY OF THE EDGE OF A SKI

[75] Inventor: Yves Gagneux, Annecy le Vieux, France

[73] Assignee: Salomon S.A., France

[21] Appl. No.: 941,222

[22] Filed: Sep. 4, 1992

[30] Foreign Application Priority Data

Sep. 4, 1991 [FR] France ..... 91 11168

[51] Int. Cl.[5] ..... B21D 53/00; B21D 3/12

[52] U.S. Cl. ..... 29/428; 72/302; 280/608; 148/609

[58] Field of Search ..... 72/302; 280/608; 148/597, 609; 29/428, 400.1, 457

[56] References Cited

U.S. PATENT DOCUMENTS

| | | | |
|---|---|---|---|
| 3,687,469 | 8/1972 | Wada | 280/608 |
| 3,871,925 | 3/1975 | Nunes | 148/609 |
| 4,402,423 | 8/1977 | Van den Sype | 148/597 |
| 5,141,243 | 8/1992 | Meatto | 280/608 |

FOREIGN PATENT DOCUMENTS

| | | | |
|---|---|---|---|
| 149581 | 12/1950 | Australia | 72/302 |
| 163542 | 6/1958 | Sweden | 72/302 |

*Primary Examiner*—Daniel C. Crane

*Attorney, Agent, or Firm*—Pollock, Vande Sande & Priddy

[57] ABSTRACT

Process for improving the elasticity of a ski edge made of corrosion-resistant martensitic chrome steel, consisting of pre-stretching the edge, and for the manufacture of a ski incorporating edges so produced.

9 Claims, 5 Drawing Sheets

PROCESS FOR IMPROVING ELASTICITY OF THE EDGE OF A SKI

FIELD OF THE INVENTION

The invention relaters to a process for improving the elastic properties of a steel edge designed for use in the manufacture of a ski. It also relates to a ski edge obtained using this process, as well as the ski equipped with such edge.

BACKGROUND OF THE INVENTION

Various types of skis are conventionally known, for which numerous variants exist. These are constituted by an elongated beam whose front end is curved upward so as to form a tip, the rear end also being curved, but in less pronounced fashion, so as to constitute the heel.

Present-day skis normally have a composite structure in which various materials are combined so that each works optimally, given the distribution of the mechanical stresses during skiing. Accordingly, this structure normally comprises peripheral protective components, internal strengthening elements used to combat flectional and torsional stresses, and a core. The structure also comprises a sliding sole which forms the lower surface of the ski, and lower metal edges forming the lower ridges of the ski. These components are bonded together or injection-assembled, assembly being normally carried out under heat in a mold having the final shape of the ski, a front part sharply raised so as to form a tip, a rear part slightly raised in the shape of the heel, and a central cambered portion.

Present-day alpine skis are fitted with carbon steel edges of the XC50 to XC70 type; i.e., containing from 0.5% to 0.70% carbon. This type of steel makes it possible, after transformation by drawing, rolling, and thermal hardening treatment, to produce, first, the specific profile dimensions of the ski edges and a hardness of 50±2 HRC, or 525±30 Vickers HV10, needed for holding the ground edge; and second, the conventional elastic limit allowing the edge to become elongated by 0.65% without deformation and to withstand the alternating flections of a ski without loss of ski camber, and which makes it possible to withstand accidental shocks against stones, without major damage. A limit of 0.5% can be achieved during skiing when violent, high-speed shocks occur, when the skier falls, etc.

For several years, a main cause of dissatisfaction among users of alpine skis has been the oxidation of the ski edges. Accordingly, a large number of ski manufacturers have tried to remedy this problem by replacing carbon steel grades with grades of the stainless martensitic chrome type, such as those used in cutlery.

To achieve the aforementioned specifications embodied in the ski edge, the grades $Z_x$ and $C_y$ have been selected, "x" being capable of variation between 20 and 40 and "y" being capable of variation between 12 and 14; i.e., steels containing from 0.2 to 0.4% carbon so as to achieve the required hardness after hardening, and containing from 12 to 14% chrome for corrosion resistance.

These attempts have ended in failure, since this type of grade does not make it possible to reach the elastic limit level (0.2% permanent deformation) required for a ski edge (approximately 1350 N/mm$_2$, corresponding to 0.65% elastic elongation).

Analysis of this limit at 0.01% showed that, for this type of edge, the limit fell to 850 N/mm$_2$, or 0.4% elongation.

SUMMARY OF THE INVENTION

It is an object of the present invention to solve the problems posed by steels used for manufacturing ski edges. The invention proposes a process allowing preservation of the anti-corrosion properties of corrosion-resistant martensitic steels, while increasing the elastic limit for that grade to a value high enough to withstand the conditions under which they are used. The process according to the invention makes it possible to impart to martensitic chrome steels an elastic limit which is close to, or even slightly greater than, the limit of XC50- to XC70-type carbon steels, in particular the widely-used XC60-type steels, which are designated in the United States as AISI C1060, and, in Germany, as WNr 1.1221 or CK60.

Thus, according to the invention the process designed to improve the elasticity of ski edges made of corrosion-resistant martensitic chrome steel consists of pre-stretching the edge and subjecting it to traction beyond its elastic limit, so as to impart to it an irreversible longitudinal deformation, while modifying its work-hardening rate.

The process according to the invention thus involves, as a conventional preliminary step, the production of the ski edge using a corrosion-resistant martensitic chrome steel, then pre-stretching it while subjecting it to traction beyond its elastic limit, and stopping the pre-stretching operation by stopping longitudinal traction. During the preliminary step, the edge is conventionally manufactured, i.e., by drawing, rolling and annealing, stamping, hardening, and tempering. Furthermore, its work-hardening rate is increased by a pre-deformation operation.

The invention also relates to the ski edge produced by use of the process, as well as the ski manufactured using the edge produced there.

BRIEF DESCRIPTION OF THE DRAWINGS

Other characteristics and advantages of the invention will emerge from the following description provided with reference to the attached drawings.

FIG. 3 represents the curve for a carbon steel and the curve for a chrome steel.

FIG. 4 represents the curve for a chrome steel and the curve for the same steel after undergoing the process according to the invention.

DESCRIPTION OF THE PREFERRED EMBODIMENT

Figure 1:
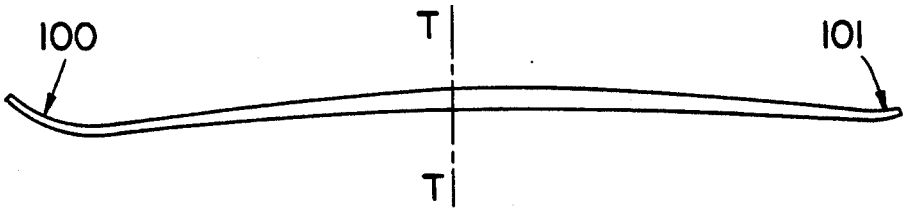
FIG. 1 is a side view showing a ski according to the invention.
Figure 2:
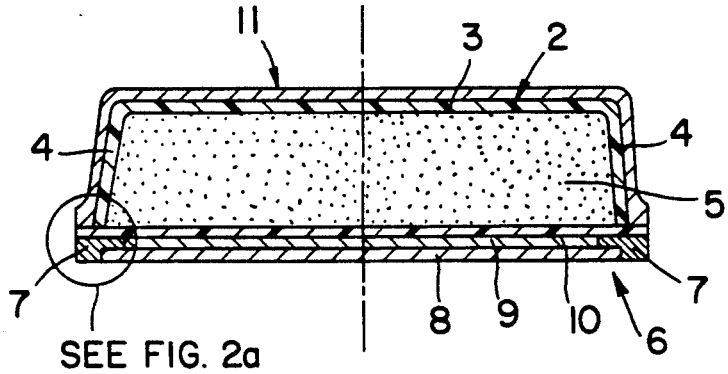
FIG. 2 is a transverse cross-section along line T—T of the ski in FIG. 1, showing the various components and, in particular, the edges according to the invention.

The ski shown in FIG. 1, which is designed to receive the edges produced according to the invention procedure, is constituted by an elongated beam comprising conventionally, to the front, a raised area forming the tip 100 and, to the rear, a slightly raised part forming the heel 101. The ski 1 may have a sandwich structure incorporating, for example, parallel flection strips arranged on either side of a core; it may also be of the caisson type, incorporating a resistance strip surrounding the core on the four surfaces, or of any other type. FIG. 2 shows an example of the structure, which comprises an upper rigid reinforcement 2 in the shape of a shell whose U-shaped section forms an upper wall 3 and two lateral walls 4 which cover a core 5, the lower part of this assembly being closed by a lower element 6 incorporating the metal edges 7, a sliding layer 8 normally made of polyethylene, and lower reinforcement elements 9, 10. An upper surface layer 11 covers the upper reinforcement and forms the decoration for the base.

The reinforcement layers 2, 9, 10 may be of any kind, e.g., layers of composite materials such as glass fiber or carbon fiber with epoxy or polyester resin, or they may be made of a metal alloy.

The core 5 may be foam, loaded or non-loaded, wood, or metal or-plastic honeycomb.

The surface layer 11 forming the decoration, whether single- or multi-layer, may be made of polyamide, acrylonitrile-butadiene-styrene, or other substance, such as a thermoplastic material.

Figure 2A:
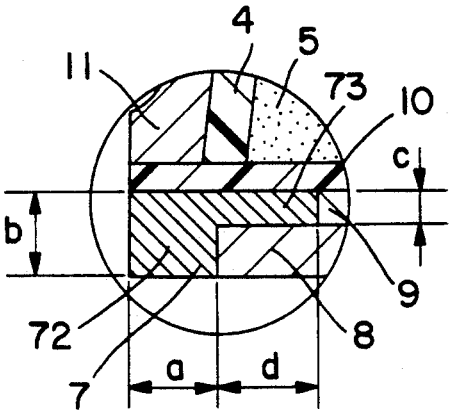
FIG. 2*a* shows a detail of FIG. 2.

The edge 7 is conventionally constituted by an L-shaped section (FIG. 2*a*), and its length is approximately that of the bottom of the ski. This section comprises a heel 72 having width "a" and height "b", and an anchoring rib 73 having thickness "c" and width "d". The dimensions of the edges are such that, for example, a=b=2 millimeters, c=0.6 millimeter, and d=3 to 6 millimeters.

Ski edges made of a non-alloyed carbon steel are generally encountered. This type of steel is currently used to manufacture skis having excellent mechanical properties, and, in particular, good elasticity. In fact, the steel used is normally XC60 steel with an elastic limit of approximately 1450 megapascals and a rupture strength of approximately 1800 megapascals.

Figure 3:
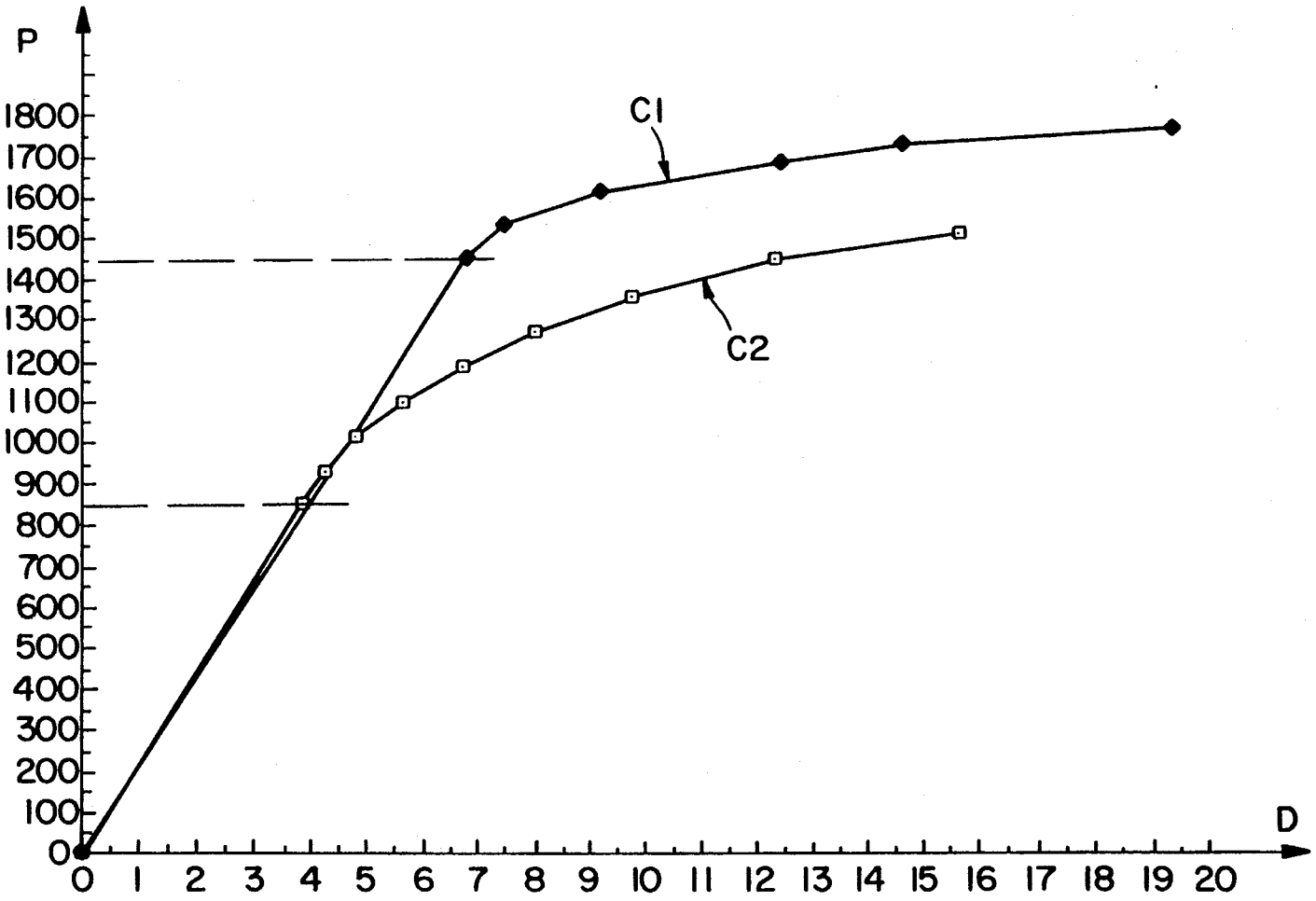
FIGS. 3 and 4 are diagrams representing stress curves as a function of deformation.

FIG. 3 represents a diagram is which the stresses P are shown as a function of the deformations D of a curve C1 for an XC60 steel and a curve C2 for a Z30C13-type corrosion-resistant chrome steel, designated in the United States under reference AISI 420, and, in Germany, under reference X30Cr13 or WNr 4028. It will be found in this first diagram that the elastic properties of the conventional XC60-type steel are excellent (curve C1), but that this is not the case for the chrome steel (curve C2), for which the elastic limit is only about 850 megapascals. Ideally, a corrosion-resistant chrome steel would thus have a curve of the C1 type to ensure that its elastic properties are sufficient to be used for manufacture of ski edges. The present invention proposes to modify the elastic properties of a ski edge made of chrome steel, so that these properties are identical to, or greater than, the properties of a non-alloyed carbon steel edge.

The first stage of the process for improvement of the elasticity of a ski edge 5 according to the invention (FIG. 5), consists of taking a ski edge 7 having an initial length "Li" and made of corrosion-resistant martensitic chrome steel, e.g., of Z30C13-type steel containing 0.3% carbon and 13% chrome. The initial length "Li" of the edge is at least equal to the length of the ski for which it is intended and is a longitudinal profile having a conventional L-shaped section, such as that shown in FIGS. 2 and 2*a*.

Figures 5, 6, 7, 8:
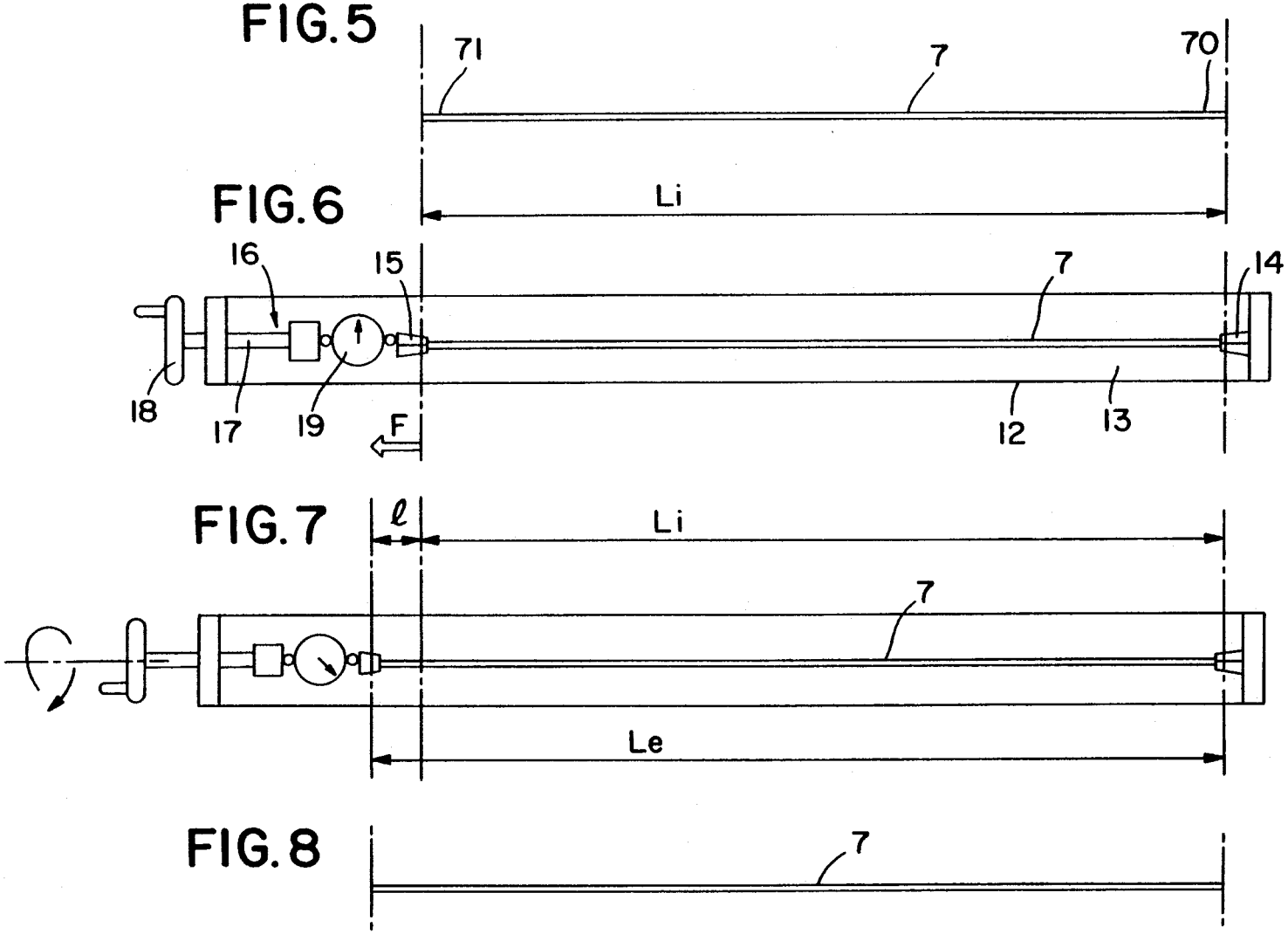
FIGS. 5 to 8 show the various phases of the process according to the invention.

In a second step, the edge (FIGS. 6 and 7) is pre-stretched using a pre-stretching unit 12 comprising a frame 13 and two position-retention jaws 14, 15, one of which (14) is stationary, while the other (15) is movable in relation to the first by means of control means 16 (shown schematically), which comprise, for example, a screw 17 and a control wheel 18. The pre-stretching unit further incorporates means 19 for measuring pre-stretching stresses and constituted, by example, by a dynamometric ring. One of the ends 70 of the edge 7 is held by the stationary jaw 14, while the other end 71 is held by the movable jaw 15. During this second phase, moving the movable jaw in direction F causes the elongation "l" of the edge until it exceeds its elastic limit, so as to impart to it an irreversible deformation. Thus, for an edge having a section of 6.6 $mm^2$ and an initial length of 2,000 mm, the stretching stresses are approximately 800 to 1,500 kilograms of force, so as to stretch it to a stretched length "Le" of between 2,014 and 2,040 mm, thus corresponding to an elongation of from 0.7% to 2% (FIG. 8).

In a third stage, stretching is stopped so as to release the edge, which thus has a stretched length "Le". To this end, the position-retention jaws 14, 15 are opened so as to free the edge, which is taken out of the pre-stretching unit (FIG. 8). The edge thus exists in a pre-stretched state having a length "Le" of 2,014 mm, and its elastic limit thus increases from 850 to 1,300 megapascals.

Figure 4:
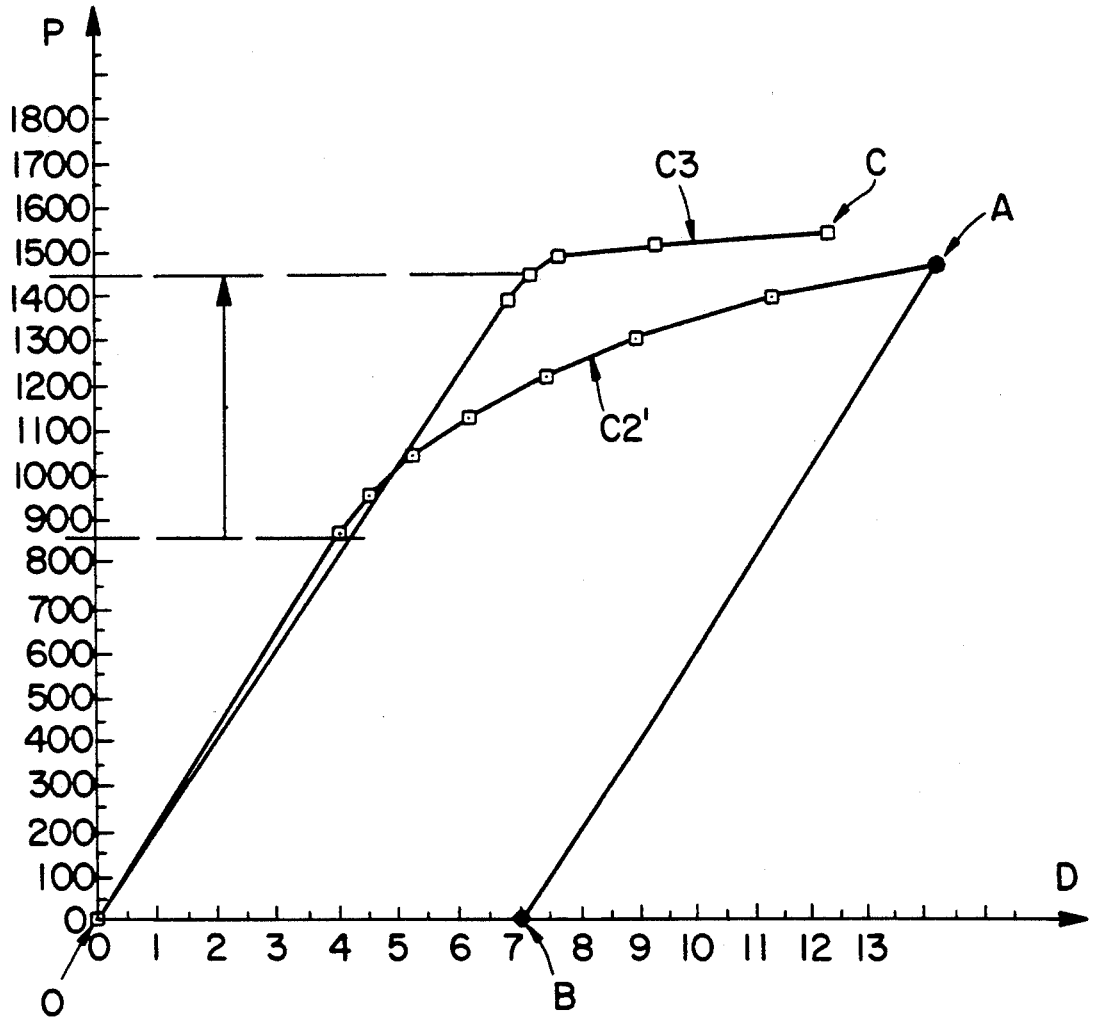

FIG. 4 is a diagram showing the stress-variation curves as a function of deformation. The deformations D are shown along the abscissa, while the stresses P are given on the ordinate. Curve C'2 illustrates the different phases of the process. The portion OA of the curve corresponds to pre-stretching, while the segment AB corresponds to relaxation, the edge thus having undergone a permanent 0.7% elongation. Curve C3 shows the new properties of the edge which underwent pre-stretching according to the invention. This diagram reveals that, by virtue of the invention, the elastic properties of the edge have been significantly improved.

Figure 9:
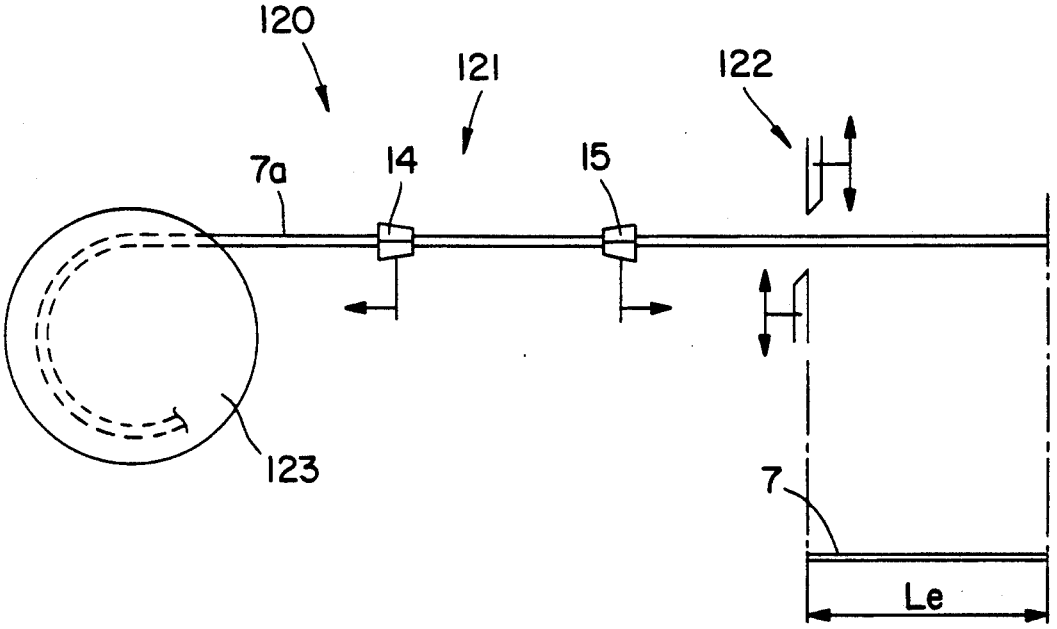
FIG. 9 represents a variant of the process.

In the process described above as one example, the edge 7 is preliminarily cut out to its initial length "Li" before being mounted in the pre-stretching unit. However, the process may vary, and pre-stretching, release from traction, and cutting may be performed continuously, as shown schematically in FIG. 9. To this end, a pre-stretching and cutting unit 120 comprising pre-stretching means 121 and pre-cutting means 122 is used. The edge 7 is initially wound on a bobbin 123.

The invention also concerns a ski equipped with edges 7 which have been pre-stretched using the inventive process, as well as the process of manufacturing a ski incorporating an edge produced by the above-described process.

What is claimed is:

1. Process for improving the elasticity of a ski edge made of corrosion-resistant martensitic chrome steel, wherein the process comprises providing corrosion-resistant martensitic chrome steel having a configuration serving as a ski edge and exerting traction on said ski edge in a longitudinal direction so as to pre-stretch said ski edge beyond its elastic limit in order to impart to it an irreversible longitudinal deformation.

2. Process according to claim 1, wherein said edge is pre-stretched while being subjected to an elongation of between 0.7 and 2%.

3. Process according to claim 1, comprising the steps of:

(a) pre-stretching the edge while subjecting it to traction exceeding its elastic limit; and (b) stopping the pre-stretching by stopping longitudinal traction.

4. Process according to claim 3, wherein longitudinal traction is exerted by holding the two ends (70, 71) of said edge (7) in jaws (14, 15), one of which moves in relation to the other so as to exert said traction.

5. Process according to claim 4, wherein one of said jaws (14) is stationary while the other (5) is movable in relation to said stationary jaw by means of control means (16).

6. Process according to claim 5, wherein said two jaws are mounted on a pre-stretching mechanism (12, 120).

7. Process according to claim 1, wherein an edge movement is cut to initial length (Li) before undergoing elongation.

8. Process according to claim 1, wherein said process is carried out using a pre-stretching and cutting mechanism (120) comprising pre-stretching means (121) and cutting means (122).

9. Process for the manufacture of a ski comprises providing corrosion-resistant martensitic chrome steel having a configuration serving as a ski edge, exerting traction on said ski edge in a longitudinal direction so as to pre-stretch said ski edge beyond its elastic limit in order to impart to it an irreversible longitudinal deformation, providing a ski and incorporating said pre-stretched ski edge on said ski.

* * * * *